United States Patent [19]

Cheng

[11] 3,966,649

[45] June 29, 1976

[54] LIQUID DETERGENTS CONTAINING CHELIDAMIC ACIDS AND SALTS THEREOF

[75] Inventor: Bao-Ding Cheng, Highland Park, N.J.

[73] Assignee: Colgate-Palmolive Company

[22] Filed: Jan. 16, 1974

[21] Appl. No.: 433,649

Related U.S. Application Data

[63] Continuation of Ser. No. 293,090, Sept. 28, 1972, abandoned.

[52] U.S. Cl. ..... 252/542; 252/117; 252/118; 252/153; 252/173; 252/180; 252/524; 252/551; 252/553; 252/559; 252/DIG. 11; 252/DIG. 14

[51] Int. Cl.[2] ..... C11D 1/29; C11D 3/28; C11D 3/33; C11D 17/08

[58] Field of Search ..... 252/110, 117, 180, 524, 252/527, 542, 546, DIG. 11, 118, 153, 173, 551, 553, 559; 210/58

[56] References Cited

UNITED STATES PATENTS

| | | | |
|---|---|---|---|
| 2,240,957 | 5/1941 | Munz | 252/546 |
| 3,001,945 | 9/1961 | Drew | 252/527 |
| 3,265,625 | 8/1966 | Grob | 252/546 |
| 3,686,124 | 8/1972 | Lyness | 252/89 |
| 3,697,453 | 10/1972 | Tate | 252/546 |
| 3,759,833 | 9/1973 | Bannerman | 252/95 |

FOREIGN PATENTS OR APPLICATIONS

| | | | |
|---|---|---|---|
| 551,132 | 12/1959 | Belgium | 252/180 |

OTHER PUBLICATIONS

Def. Pub. T903,010, R. D. Kastra, Published 10–3–72.

"Amino Acid Chelating Agents in Detergent Applications," by R. R. Pollard, *Soap & Chemical Specialties*, Sept. 1966, pp. 58–62 & 130–135.

"The Metal Complexes of Chelidamic Acid," by G. Anderegg, *Helv. Chim. Acta* 46 (3), 1963, pp. 1011–1017.

*Primary Examiner*—Dennis L. Albrecht
*Attorney, Agent, or Firm*—Herbert S. Sylvester; Murray M. Grill; John J. Tomaszewski

[57] ABSTRACT

A non-phosphate and non-Nta-containing detergent composition comprising from about 30 to 95% by weight of a detergent, especially an anionic or nonionic detergent and from about 5 to 70% by weight of chelidamic acid or 4-hydroxy-2,6-pyridine dicarboxylic acid hereinafter referred to as "4H" acid, and salts thereof.

1 Claim, No Drawings

LIQUID DETERGENTS CONTAINING CHELIDAMIC ACIDS AND SALTS THEREOF

This is a continuation of application Ser. No. 293,090 filed Sept. 28, 1972, now abandoned.

This invention relates to builders for synthetic detergents and, more particularly, to calcium ion sequestering agents as substitutes for phosphate builders in detergent compositions.

It is widely known that detergent compositions for use in home laundering and general purpose washing operations have been rapidly developed and improved in accordance with existing technology, the demand of the consumer and the need to develop products which overcome specific problems which arise in the cleaning art. For example, in the past, it was readily accepted that the cleaning power of a detergent composition was proportional to the amount of sudsing or foaming the composition could produce in the washing medium. Therefore, various additives were developed which, when added to detergent compositions, produced voluminous amounts of suds or foam. However, with the advent of the automatic washing machine, the extensive foaming produced by the more efficient agitation encountered in these machines created increasing problems with rinsing the suds from the materials being washed and disposing of the suds into sewage systems. To overcome these problems, powerful detergents were developed which possess low foaming properties. Such powerful detergents commonly contain phosphate builders which are used to improve the detergency levels of the detergent compositions. Although several factors are involved in obtaining cleaning agents with high levels of detergency one such factor is believed to be the interference of metal ions normally present in water with the active ingredient of the cleaning composition and another is the redeposition of these metal ion salts on the washed article. Several phosphate type builders are known to be effective in the sequestration of these ions in washing solutions. However, due to the high molecular weight of the phosphate builders and their susceptibility to hydrolysis and limited degradation in water and further, because of the widespread use of such phosphates and detergents today, serious problems such as pollution of rivers, lakes and streams have been attributed to the great volume of such phosphates dumped into these bodies of water. Therefore, much attention has recently been given to the replacement of the phosphate materials in detergent compositions with materials which are biodegradable and lessen the danger of pollution of waters.

As can be appreciated from the foregoing, several factors must be considered in the replacement of phosphates as builders for detergent compositions so that predictability of the effect of one compound on another is virtually non-existent. One example of the complexity of the problem of substitution of phosphate builders is demonstrated by the history of substitution of nitrilotriacetic acid for polyphosphates in detergents. Within the past decade when the possibility of water pollution as the result of the use of billions of pounds of phosphates in detergents became apparent, manufacturers turned to nitrilotriacetic acid (NTA) as the replacement for the phosphate builders because of its known sequestration properties. However, much controversy has arisen over the possibility that NTA may be an even more deleterious agent to the environment than the polyphosphates. Consequently, the replacement of phosphate builders with NTA has recently been discontinued as a suitable solution to the problem.

Several polycarboxylic acid containing compounds have been used as effective calcium, magnesium, iron and aluminum metal ion capturing or chelating materials. As is shown in U.S. Pat. No. 2,264,103, acetyl citric acid, tricarballylic acid, aconitic acid, mellitic acid and the like are utilized for chelation of such ions present in water to soften it. Other efforts are noted in the search to find polycarboxylic acid containing materials having the sequestration properties of the phosphate and NTA builders but without the disadvantageous environmental consequences thereof. U.S. Pat. No. 3,459,670, for example, discloses the use of cycloalkane tri- and tetracarboxylic acids as detergent builders in liquid cleaning compositions. Somewhat similar detergent builders are disclosed in U.S. Pat. No. 3,580,852 wherein water soluble salts of tetrahydrofuran 2,3,4,5, tetracarboxylic acids are substituted for the well known phosphate builders. Likewise the use of oxydisuccinic acid salts is recognized in U.S. Pat. No. 3,635,830 to be an effective phosphate builder replacement.

In addition to the above considerations, several other properties of the phosphate builder substitutes must be considered which thereby intensifies the effort required to find suitable substitutes. Major considerations, include for example, the detergent cleaning power enhancement of the builder, the compatibility of the phosphate builder substitute with solvents and other ingredients utilized in liquid and dry detergent compositions, the metal ion control properties of the builder and the stability of such builders when used with bleaching agent and many other additives.

It is within the above environment and background that the composition of the present invention was developed. Briefly, the instant composition, which provides a non-phosphate and non-NTA-built detergent composition having similar detergency comprises from 95 to 30% by weight of a detergent and from 5 to 70% by weight of chelidamic acid, 4H and acid water soluble salts thereof.

Accordingly, it is an object of the present invention to provide an improved builder substitute for synthetic detergent compositions.

It is another object of the present invention to provide a builder substitute for synthetic organic detergents which may replace all or part of the conventional phosphate builders previously used.

It is still another object of the present invention to provide a phosphate builder substitute which is compatible with the organic solvents used in liquid detergents.

It is still a further object of the present invention to provide a builder for synthetic detergent compositions which has metal ion control properties at least equal to those of conventional phosphate builders.

It is a still further object of the present invention to provide a non-phosphate containing detergent composition containing a chelidamic acid, "4H" acid or salt thereof as a builder or builders.

Other objects and advantages will become more apparent from the following more detailed description.

The foregoing objects and advantages are achieved by the detergent composition of the present invention which comprises from 95 to 30% by weight of a detergent selected from a nonionic, anionic, cationic, amphalytic or zwitterionic detergents and 5 to 70% by weight of chelidamic acid, "4H" acid or salt thereof.

In accordance with the present invention, it has been found that chelidamic and 4-hydroxy-2,6-pyridinedicarboxylic acid and the water soluble salts thereof are effective as builder substitutes for synthetic detergents and may therefore be used in place of the conventional phosphorus containing builders. These compounds have a relatively high charge density, a low molecular weight and yield particularly good metal ion control and anti-redeposition properties when used in detergent compositions.

The chelidamic acid and "4H" acid salts which are suitable replacements for prior art builders include the disodium salt, dipotassium salt, diammonium salt, etc. Suitable other salts include alkylamino salts, alkanolamine salts and water soluble salt-forming from any salt forming material which does not interfere with the chelating activity of the acids.

The chelidamic acid, "4H" acid and water-soluble salts thereof may be used as builder substitutes in a wide variety of synthetic detergents, such as anionic, nonionic, cationic, ampholytic zwitterionic and mixtures thereof. The acids and the salts thereof are especially useful as builders for nonionic and anionic detergents, especially straight chain biodegradable anionics and non-ionics. The effectiveness of the builder substitutes in such detergent compositions is at least equal to that of the phosphate builders conventionally used, such as sodium tripolyphosphate, at the conventional pH levels of the washing medium. In addition to the aforementioned properties, the compounds of this invention provide the detergent with cleaning powers equal to that of the phosphate built detergents and, without the undesirable environmental consequences of phosphate build-up in rivers, lakes, streams and other bodies of water. An additional factor important to the suitability of the chelidamic acid builders of this invention is the improved clarity of final liquid detergent products due to the fact that the builders of this invention are more compatible with the organic solvents normally used in liquid detergents than are the conventional phosphate builders.

The effectiveness of chelidamic acid, "4H" acid and water-soluble salts thereof has been found to be equivalent to sodium tripolyphosphate on a weight basis and therefore chelidamic acid, "4H" acid and water soluble salts thereof may be used in amounts which are generally known to be acceptable and effective for phosphate built detergent compositions e.g., from 5 to 70% by weight and preferably 10 to 50% by weight of the detergent composition. The weight percent of detergent and builder present in a washing solution is generally from 0.05 to 2.5 weight percent with normal detergent concentration being about 0.1%. At these standard concentrations, the detergent builder of this invention provides a dilute solution which appears colorless.

The synthetic detergent and washing solution of this invention should generally be used at a pH above 8 and preferably at a pH above 9. Because of the desirability of an alkaline pH and because most synthetic detergent compositions yield only mildy alkaline solutions in use, it may be necessary to adjust the pH of the final detergent compositions of this invention, since the acids and the salts thereof are not basic themselves, using conventional pH adjustment techniques.

As previously mentioned, the builder may be used with any conventional detergent classes, such as anionic, cationic, nonionic, ampholytic, zwitterionic and any suitable mixtures thereof. Other detergent materials, such as soaps of coconut oil, palm kernel oil and the like, may also be utilized with the novel builders of this invention to produce improved cleaning compositions. These soaps are well known, highly saponified mixtures of long chain fatty acids of from 12 to 18 carbon atoms.

The anionic surface active compounds are generally described as compounds which contain hydrophilic and lipophilic groups in a molecular structure and which ionize in an aqueous medium to give anions containing the lipophilic group. Typical of these compounds are the sulfonated or sulfated alkyl, aryl and alkyl hydrocarbons and alkali metal salts thereof, such as sodium dodecylbenzene sulfonate, sodium tridecylsulfonate, magnesium dodecylbenzene sulfonate, potassium tetradecylbenzene sulfonate, ammonium dodecyltoluene sulfonate, lithium pentadecylbenzene sulfonate, sodium dioctylbenzene sulfonate, disodiumdodecylbenzene disulfonate, disodium di-isopropylnaphthalene disulfonate and the like as well as the alkali metal salts of fatty alcohol esters of sulfuric and sulfonic acids, the alkali metal salts of alkyl aryl (sulfothionic acid) esters and the alkylthiosulfuric acid salts and the like, sodium salts of sulfonated mineral oils, sodium salts of sulfosuccinic acid esters and the ethoxylated alkanol sulfates of the formula $RO(C_2H_4O)n\ SO_3M$, wherein R is an alkyl group, preferably having a straight chain of from 10 to 20 carbon atoms, n is a number from 2 to 6, preferably being from 1/5 to ⅓ the average number of carbon atoms in R and M is a cation selected from alkali metals such as sodium, potassium, etc., ammonium, lower alkylamino and lower alkanolamino, such as mixed $C_{12-15}$ normal primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; mixed $C_{10-18}$ normal primary alkyl triethenoxy sulfate, potassium salt, etc.

By the term "cationic detergents" is meant surfactants which ionize in an aqueous medium to give cations containing the lipophilic group. Some typical examples of these compounds are the quaternary ammonium salts which contain an alkyl group of about 12 to 18 carbon atoms, such as laurylbenzyldimethylammonium chloride.

The nonionic surface active agents are generally described as compounds which do not ionize in water solutions. Usually, these compounds possess hydrophilic characteristics by virtue of the presence of an oxygenated side chain, such as polyoxyethylene with the lipophilic part of the molecule coming from fatty acids, phenols, alcohols, amines or amides. Suitable examples of nonionic surfactants are the products formed generally by condensing one or more alkylene oxides of 2 to 4 carbon atoms, such as ethylene oxide, propylene oxide and the like, with relatively hydrophobic compounds, such as fatty alcohols, fatty acids, sterol, fatty glycerides, fatty amines, aryl amines, fatty mercaptans, tall oil and so on. Other suitable nonionic surfactants include those products produced by condensing one or more relatively lower alkanolamines, such as methanolamine, ethanolamine, propanolamine and the like, with fatty acid, abietic acid, and so on, to produce the corresponding amide.

The synthetic nonionic detergents utilized will normally be nonionic synthetic organic detergents known for their utility in separating dirt, grease, stains and other soil from fabrics such as cottons, polyesters, cotton-polyester blends, nylons, acrylics rayons, woolens and other fibrous materials. While several possible nonionic surface active compounds are mentioned above, particularly advantageous nonionic detergents are the condensation products of a hydrophobic compound having at least one active hydrogen atom and a lower alkylene oxide, i.e., from about 3 to 30 moles of alkylene oxide per mole of active hydrogen atom or the condensation product of an alkyl phenol containing from about 8 to about 18 carbon atoms in the alkyl group and from about 3 to 30 moles of ethylene oxide per mole of alkyl phenol. One other advantageous nonionic detergent is the type produced by condensation reaction of ethylene oxide and a hydrophobic compound formed by the precondensation of polyethylene oxide with propylene glycol.

For satisfactory detersive activity, rather than wetting or emulsifying effects alone, the lipophilic portion of the nonionic detergent molecule will generally contain at least 10 or 12 carbon atoms and will be free or substantially free of solubilizing radicals such as hydroxyl and O—Me groups, wherein the Me stands for a cation, such as alkali metal, ammonium, amine or alkanolamine. In preferred embodiments of the invention the nonionic detergent will contain from 10 to 24 carbon atoms in the lipophilic moiety or the hydrophobic portion of the molecule, from 10 to 18 of which will usually be in an alkyl group, preferably a linear alkyl. Such alkyl may be joined to an aryl, such as a phenyl, toluyl or xylyl group, but is preferably the sole lipophilic portion of the detergent molecule. In most preferred embodiments, the nonionic detergent will include a linear alkyl lipophilic moiety which is unsubstituted and which contains an average of from 12 to 15 carbon atoms, preferably averaging 14 to 15 carbon atoms. Thus, from 10 to 18 carbon atoms may be in the higher alkyl or alkoxy portion of the molecules, preferably from 12 to 16 carbon atoms. In the poly-lower alkoxy moiety, the extent of its hydrophilic nature may be regulated by including some polypropoxy groups but these will generally be limited in number to less than ⅓ the number of ethoxy groups because the propoxies, when formed into a chain, are usually lipophilic. Preferably, the chain will be entirely polyethoxy and from 4 to 40 carbon atoms will be present in such poly-lower alkoxy chain, preferably 6 to 30 carbon atoms and more preferably 14 to 22 carbon atoms. Such compounds are available commercially under the trade names Neodol 45-11, Plurafac B-26, Alfonic 1618-65 and Neodol 25-7.

Although not as preferable as the other nonionics already mentioned for the manufacture of detergent products, various other nonionic detergents used are as described in the texts *Surface Active Agents and Detergents*, Vol. II, by Schwartz, Perry and Berch, published in 1958 by Interscience Publishers, Inc., and *Detergents and Emulsifiers*, 1969 *Annual* by John W. McCutcheon. Among such nonionic compounds are the higher alkyl phenoxy poly-lower alkoxy lower alkanols, e.g., nonyl phenoxy polyethoxy ethanol (Igepal CO-880) and balanced hydrophilic-lipophilic compounds made by the condensation, either random or block, of hydrophilic lower polyalkylene oxides or lower alkylene oxides (ethylene oxide) with lipophilic lower polyalkylene oxide or lower alkylene oxides (propylene oxides), e.g., Pluroncis F-68 and L-44, and various Ucons. The lower alkylene oxides are of two or three carbon atoms and the nonionic detergents that are useful may contain from 4 to 100 moles of lower alkylene oxide per mole of compound.

It may further be noted that other nonionic surface active compounds, such as amine oxides and phosphine oxides like the unsymmetrical trialkyl-amine oxides and phosphine oxides wherein two of the alkyl groups are lower alkyl ($C_1 - C_4$) and the third alkyl group is a higher alkyl group ($C_8 - C_{18}$) may also be combined with the detergent builders of this invention. A specific example such an amine oxide is dimethyltetradecyl amine oxide.

The ampholytic surface active agents are generally compounds having both anionic and cationic groups in the same molecule. Such materials are generally derivatives of aliphatic amines which contain a long chain of about 8 to 18 carbon atoms and an anionic water solubilizing group, such as sulpho, sulfato and carboxy. Exemplary of the ampholytic detergents are sodium-3-dodecylaminopropionate, sodium-3-dodecylaminopropane sulfonate, sodium N-methyl taurate and related compounds, such as the higher alkyl disubstituted amino acids, betaines, thetines, sulfated long chain olefinic amines and sulfated imidazolidine derivatives.

The synthetic detergents known as zwitterionic surfactants are generally derivatives of aliphatic quaternary ammonium compounds in which the aliphatic radical may be straight chained or branched and wherein one of the aliphatic substitutents contains from about 8 to 18 carbon atoms and one contains an anionic water solubilizing group such as the sulfo, sulfato and carboxy groups mentioned above. Some examples of zwitterionic surfactants are 3-(N,N-dimethyl-N-hexadecylamine)-propane-1-sulfonate and the related hydroxy propane derivative.

It is important to note that while the above mentioned synthetic detergents are merely typical compounds acceptable for use with the builders of this invention, they do not constitute an exhaustive listing of suitable detergents. Other typical examples of these detergents are described in Schwartz, Perry and Berch *Synthetic Detergents*, Interscience Publishers, New York, (1958), pp. 25–143 and the *Journal of American Oil Chemists Society*, Vol. 34, No. 4, pp. 170–216 (1957) which are incorporated by reference. Suitable mixtures of many of the aforementioned detergents are also encompassed by this invention.

Although a wide range of detergents has been found to be suitable for use with the chelidamic acid compounds of this invention, the pH of the detergent in the washing solution should be maintained at or above 8, preferably above 9, for best results. At these pH levels, the cleaning composition possesses remarkable clearness, even when diluted with water of relatively high hardness (150 p.p.m. calcium hardness, as calcium carbonate) to form the conventional washing medium. At pH levels below about 8, the effectiveness of the calcium ion sequestration properties of chelidamic acid is seriously limited.

When the final composition is in the form of a liquid detergent, it may include a lower monohydric alcohol and polyhydric alcohol having from 2 to 4 carbon atoms such as ethanol, isopropanol, n-propanol, n-butanol, sec-butanol, t-butanol, propylene glycol, ethylene glycol, etc. Although any of the above lower monohydric alcohols can be used, isopropanol is preferred. Suitable amounts of alcohols are widely variable depending upon the makeup of the detergent composition, but generally, may be said to range from 7–25% and preferably from 7–15% by weight. The lower monohydric alcohol is important to the composition of the present invention since the lower monohydric alcohol prevents the formation of a gel when the anionic materials are added to warm water. Although the initial gels dissolve with a little stirring, it is preferred for both practical and aesthetic reasons that the liquid detergent composition of the present invention be readily dispersed in water upon immediate pouring of the same into the wash water. Since gelling and improper dispersion in the wash water create high concentrations of soap and other adjuvants and materials included in the novel detergent composition of the present invention, this leads to a marked degree of staining if the lower monohydric alcohol is omitted from a liquid detergent composition.

The final detergent compositions may also contain, in addition to the above mentioned surfactants and the chelidamic acid compounds, minor amounts of other commonly used materials which enhance the effectiveness or attractiveness of the finished product. Included in what may be considered minor additives of this type are conventional soil redeposition inhibitors, sequestering agents, pH adjustors, hydrotropic agents, conventional detergent builders, polyelectrolytes, solvents, dyes and pigments, fluorescents, perfumes, brightening agents and the like.

The water used in liquid detergent compositions is preferably deionized so that it will be low in content of ions which can form insoluble compounds. However, ordinary tap water can be used providing that the hardness thereof is sufficiently low so that there is no detrimental precipitation out of salts on standing. When additional sequestrants are used, hardness will be less important and in such cases even waters with hardnesses over 300 parts per million equivalent calcium carbonate can be acceptable. Generally, however, the water hardness should be less than 150 ppm and most preferably, less than 50 ppm.

The additional sequestering agent, when used, may be any suitable such compound, including the aminopolycarboxylic acids and hydroxycarboxylic acids. Thus, ethylene diamine tetraacetic acid, nitrilotriacetic acid, hydroxyalkyl derivatives thereof in which the hydroxyalkyl group replaces one or more acetic acid groups, gluconic acid, ascorbic acid, glucono-delta-lactone (which is converted to gluconic acid), citric acid, lactic acid and salts thereof, especially those of the water soluble alkali metals, e.g., sodium, potassium, ammonium, alkanolamines and amines, may be used. Other sequestering or water-softening agents of the inorganic type such as certain phosphates may be used in very small amounts if desired but are not present in amounts sufficient to have a builder function.

Other specific adjuvants which may be present in the liquid detergent to give it additional properties, either functional or aesthetic, are soil suspending or anti-redeposition agents, e.g., polyvinyl alcohol, sodium carboxymethyl cellulose, hydroxypropylmethyl cellulose; enzymes, e.g., proteases amylases; thickeners, e.g., gums, alginates, agar agar; hydrotropes, e.g., sodium xylene sulfonate, ammonium benzene sulfonate; foam improvers, e.g., lauric or myristic diethanolamide; foam destroyers, e.g., silicones; bactericides, e.g., tribromosalicylanilide, fungicides; dyes; pigments (water dispersible), preservatives; ultra-violet absorbers; fabric softeners; pearlescing agents; opacifying agents, e.g, behenic acid, polystyrene suspensions; and perfumes. Of course, such materials will be selected for the properties desired in the finished product and to be compatible with the other constituents thereof.

Although one advantage of the builders of this invention is an increased compatibility in the liquid detergent form, the chelidamic acid builders of this invention are advantageous in detergent compositions in the forms of granular, tablet, flakes, powders, bars or any other conventional form of detergents known in the art.

Likewise, the method of manufacture is not critical to the invention in that the builders may be mixed in any mixing sequence with the detergent composition, such as by being dissolved in the surfactant, being slushed in the surfactant in the slurry form, or by any other conventional mixing procedure.

The proportions of the various components in the present detergent composition may be varied within acceptable ranges to produce a composition with acceptable laundering action and also to obtain a uniform product. Generally, the detergent portion of the cleaning composition comprises from 30 to 95% of the final product.

The fluorescent or optical brightener which may be included in the composition of the present invention should be present at a concentration of from 0.5 to 5% on an active ingredient basis, preferably about 1 to 3% and most preferably about 2%. These quantities are readily solubilized in the water-isopropyl alcohol base of a liquid detergent composition. Generally, at least 25% and preferably at least 50% of the optical brightener will be a brightener for cotton, and it is preferred to utilize from 51% to 90% of the cotton brightener with the balance being one or more polyamide, polyester or chlorine stable brighteners.

The lower monohydric alcohol will be present in a suitable proportion to maintain the detergents in a non-gelled state and sufficient alcohol will be present to aid in stabilizing and dissolving various other constituents in the product. As noted above, the utilization of a lower monohydric alcohol, preferably isopropanol, enables the formation of a thin or less viscous concentrated product and the alcohol is generally employed in an amount from 7 to 15% by weight, preferably around 10% by weight. Furthermore, the percentage of water utilized in the composition of the present invention may be from 5 to 50% by weight with the preferred range being from 25 to 40% by weight.

The sequestrants and adjuvants which are utilized should generally not exceed a total concentration of 10% and generally will be maintained at less than 5% and preferably less than 3%. Furthermore, any individual component should not exceed 5%, preferably 3% and most preferably is less than 1% of the product.

In the preferred liquid form, the use of the present compositions is marvelously simple and efficient. Compared to present heavy duty laundry detergent powders, much smaller volumes of the present liquids may be employed to obtain cleaning of soiled laundry. For example, in a typical and preferred formulation of this invention, only about 2 ounces or ¼ cup of liquid need to be used for a full automatic machine tub of wash, in which the water volume might be from 15 to 18 gallons. Thus, the concentration of liquid detergent in the wash water is on the order of 0.1%, 1 gram per liter or 1,000 parts per million. Generally, the proportion employed will be from 0.7 to 1.5 grams per liter. The proportions of other constituents of the liquid compositions may vary accordingly. Of course, equivalent results can be obtained by using larger proportions of a more dilute liquid detergent but the greater quantity needed will require additional packaging and shipping space and will be less convenient for the consumer to use. However, it is considered that the use of such more dilute products is within the present invention if the relative proportions of components is maintained. In other words, the present invention is not avoided by merely preliminarily diluting the liquid detergent with water since the same end result is obtained because the wash water also serves to dilute the detergent down to a use concentration.

Although it is preferred to employ wash water of reasonable hardness and at an elevated temperature, the present invention is also useful in laundering clothes and other items in hard waters and in extremely soft waters, as well as in waters at room temperature or below. Thus, water hardnesses may range from 0 to over 300 parts per million as calcium carbonate and washing temperatures may be from 10° to 80°C. Preferably, the temperatures will be from room temperature, 20° to 25°C., to 70°C. Also, although washing will ordinarily be effected in an automatic washing machine, with the washing followed by rinse and spin or draining or wringing operations, it is contemplated that the detergent may also be used for hand washing of laundry. In such cases, the concentration in water of the liquid detergent will often be increased and sometimes it may be full strength to assist in washing out otherwise difficult to remove soils or stains. After completion of the washing and spinning operations, it will be general practice to dry the laundry in an automatic dryer soon thereafter but such particular drying operation is not necessary.

When the liquid detergent is added to water, whether that water is hot or cold, the detergent immediately dissolves uniformly throughout the wash water, even in the absence of significant agitation. Washing and brightening agents are carried into contact with all the laundry and there are no localized overconcentrations of either of these materials. The clothing washed, following normal methods, is exceptionally clean and in comparative tests the product has been rated as good as some of the best of the commericial heavy duty detergents on the market. Although it is a low- or non-foaming detergent composition and thus very suitable for side-loading washing machines, excellent washing is also obtained in top loading machines in which foaming detergents are normally employed. Repeated testing of soiled and re-soiled laundry items, using te present compositions and larger quantities of commercial heavy duty detergents built with phosphate or NTA, shows that the soilings are repeatedly removed and no objectionable build-up thereof occurs. For the most part, users do not note any really significant differences between the washing properties of the present composition and commercial compositions tested. In fact, there has been a significant preference for the present product.

The novel compositions of the present invention will now be illustrated by the following specific examples which are for the purposes of illustration only and are to be taken as in no way limiting the scope of the instant invention. In the following examples, all the parts and percentages are by weight and all temperatures in degrees centigrade, unless otherwise noted.

EXAMPLE 1

A clear liquid soap composition having the following formula is prepared by mixing the potassium coconut oil soap in hard water and adding the isopropyl alcohol mixture of chelidamic acid thereto with stirring. After the solution is well mixed, it becomes clear.

| | |
|---|---|
| Potassium soap of coconut oil | 15 grams |
| Chelidamic Acid | 10 grams |
| Isopropyl alcohol | 10 grams |
| Water (hardness = 150ppm Ca++/Mg++) | 65 grams |

The above composition is turbid at first but, with vigorous agitation, produces good sudsing activity and when allowed to stand, becomes very clear. Such clarity and good sudsing ability of the soap in water of relatively high hardness demonstrate the excellent calcium ion sequestration properties of chelidamic acid.

EXAMPLE 2

A mixture of sodium salts of $C_{12}$ – $C_{18}$ carbon atoms long chain fatty acids is maintained in heavy fluid form so that the disodium salt of chelidamic acid can be homogeneously blended therewith. Various adjuvants are then added to the thick mixture. The soap composition is then transferred to a conventional solid soap bar making apparatus and the minor amount of solvent present is removed. The resultant product has the following composition and provides a solid soap-bar which may be used in the conventional manner:

| | |
|---|---|
| Sodium Salt of $C_{12}$– $C_{18}$ long chain fatty acids | 70% |
| Di-sodium salt of chelidamic acid | 29 |
| Perfume | .1 |
| Coloring agent | .5 |
| Germicidal agent | .4 |
| | 100% |

This soap bar provides excellent cleaning action when used for washing glass test plates in water of varying hardnesses (e.g., calcium ion content of 50 ppm, 100 ppm, 150 ppm and 300 ppm). All of the glass plates appear cleaner than the control plates washed with the same soap composition but without the sodium salt of chelidamic acid.

This example demonstrates the chelating activity of the cleaning composition in the form of a hard soap or bar-soap.

EXAMPLE 3

A clear liquid detergent having the following formula is prepared by slurrying a mixture of optical brighteners in isopropanol followed by the addition of water with stirring. Subsequently, the anionic detergent is added and following a few minutes agitation at moderate speed, the solution becomes clear:

| | |
|---|---|
| Neodol 25–3S ($C_{12-15}$) alcohol 3 EO sulfate, sodium salt, 60% active ingredient | 45.0% |
| chelidamic acid | 18.4% |
| Isopropyl alcohol | 8.6% |

-continued

| | |
|---|---|
| Brighteners | 1.1% |
| Water | q.s. |
| | 100.0 |

The above formulation forms a clear, one-phase, low viscosity liquid detergent which dissolves rapidly and completely in wash water at 38°C without any stirring whatsoever. Furthermore, when compared with other biodegradable detergent compositions with or without builders, the above noted composition possesses similar detergency and cleaning characteristics.

Using formulas similar to that given above, in which the fatty alcohol-polyoxyethylene condensation product is changed, so that the alkyl group is of 10, 12 or 16 carbon atoms or a mixture thereof and the polyoxyethylene chain is of 8, 10 or 14 ethylene oxide groups or a mixture thereof, similarly effective detergency is obtained. Such is also the case when different optical brighteners are employed and when sodium hydroxide, potassium hydroxide, triethanolamine or ammonia is utilized instead of monoethanolamine as an alkaline material. Such products also remain clear on storage despite the presence of small quantities of metal ions which can form insoluble salts. Also, no discoloration is noted in clothing washed with such products even when ordinary tap water is used for such washings and when it contains as much as 150 parts per million of hardness, as calcium carbonate, and includes iron.

When the proportions of the various components are changed, within the ranges recited, an acceptable clear liquid product is obtainable and this is also the case when selected adjuvants of the type described are employed in small quantities for their desired effects. When it is desired to make the product opaque, creamy or cloudy, usually for marketing purposes, an opacifier such as behenic acid results in a uniformly cloudy product, when employed at about 1% concentration. Although clear and stable liquid detergent solutions are obtainable, care should be exercised in formulation. For example, if an excessive quantity of an anionic detergent, e.g., over 7% of lauryl alcohol sulfate, is utilized, separation of the product into two phases may occur. Similarly, if the content of ethanol or isopropanol is diminished below 5%, the fatty alcohol-ethylene oxide condensate will often gel.

EXAMPLE 4

The following ingredients are mixed together in liquids of the composition until a clear homogeneous product results:

| | |
|---|---|
| Neodol 45-11 (polyethoxy nonionic surfactant with 14 to 15 carbon atoms in the fatty alcohol and 11 mols of ethylene oxide in the polyethoxy group | 62.5 |
| pH adjuster | 2.5 |
| Di-sodium salt of chelidamic acid | 25 |
| Isopropanol | 10 |

-continued

| | |
|---|---|
| | 100 |

The above formulation forms a clear, one-phase, low viscosity liquid detergent which dissolved rapidly and completely in wash water at 100°F. without any stirring whatsoever. Furthermore, when compared with other conventional detergent compositions, whether biodegradable or non-biodegradable and whether built or non-built, the above noted composition possesses similar detergency and cleaning characteristics.

EXAMPLE 5

A liquid detergent composition containing 15.0% Neodol 25-3S, 1.8% of 80/20 tallow-coco soap, 20% chelidamic acid, diammonium salt, 8.9% isopropyl alcohol and 35.7% water, impurities and brighteners is prepared. When this formulation is placed in a top-loading washer without laundry in 17 gallons of 49°C tap water, 51 grams of this formulation fill only 50% of the air space of the washing machine with foam and there is no foam in the rinse water. However, a similar amount of a formulation without the tallow-coco soap completely fills the air space within the washer with foam within 3 minutes and there is some foam in the rinse water.

EXAMPLE 6

This example demonstrates the improved compatibility of the builders of this invention in detergent compositions when compared to a conventional phosphate built detergent comprising 15% linear triadecyl benzene sulfonate, 35% pentasodium tripolyphosphate and 50% sodium sulfate at a 0.15% concentration in water.

In the phosphate built detergent and each of the detergent formulations given in Examples 1, 3, 4 and 5 above, the isopropyl alcohol content is varied as follows with a proportionate increase in water content:

| | |
|---|---|
| A | 5% |
| B | 10% |
| C | 15% |
| D | 20% |
| E | 25% |
| F | 30% |

Although each of the above variations provides detergents with adequate detersive properties, the phosphate built detergent was cloudy in water at the isopropanol contents of Examples D, E and F while the detergent compositions of the instant invention were all entirely clear.

EXAMPLE 7

The following formulations are prepared and are tested against a control comprising 15% linear triadecyl benzene sulfonate, 35% pentasodium tripolyphosphate and 50% sodium sulfate at a 0.15% concentration:

| | % | | | | | |
|---|---|---|---|---|---|---|
| | A | B | C | D | E | F |
| Neodol 25-3S | 53.6 | 46.2 | 54.6 | 42.1 | 31.0 | 36.9 |
| Neodol 4511 | — | 11.5 | — | — | 10.3 | — |
| Chelidamic acid | 25.0 | 18.0 | 20.0 | 22.0 | 22.0 | 25.0 |
| LDBS | — | — | — | 10.5 | 10.3 | — |
| $C_{12-15}$ Alcohol Sulfate | — | — | — | — | — | 9.2 |
| Soap, 80/20 Tallow/Coco | 1.8 | 1.9 | — | — | — | — |
| Ispropyl Alcohol | 8.9 | 9.6 | 10.0 | 8.8 | 8.6 | 7.7 |
| Water and Impurities | — | — | — | — | — | — |
| | g.s. | g.s. | g.s. | g.s. | g.s. | g.s. |

-continued

| % | | | | | |
|---|---|---|---|---|---|
| A | B | C | D | E | F |
| 100.0 | 100.0 | 100.0 | 100.0 | 100.0 | 100.0 |

When each of the above formulations is tested at a 0.1% concentration in Spangler Soil Tests, the results are observed by measuring Rd as a measure of greyness on a scale of 1–100 (100 being white) with a Gardner Automatic Color Difference Meter. About a one Rd unit difference is visually discernible. In each of the Spun Nylon soiled cloth samples (Testfabrics, Inc.) washed the Rd reading did not differ greater than 1 unit from the Rd reading of the fabric washed in the phosphate builder composition. Further, upon visual examinations, the samples A–F could not be distinguished from the phosphate washed control sample. Thus, the builders of the instant invention are shown to be at least equal to the conventional phosphate builders for cleaning power.

EXAMPLE 8

A white, free-flowing, spray-dried detergent having the following formula is evaluated in comparison with a commercially acceptable detergent utilizing New Brunswick, N.J., tap water containing about 100 parts per million magnesium and calcium hardness as expressed, calcium carbonate:

| | % |
|---|---|
| Neodol 25–3S | 15.00 AI |
| Soda Ash | 45.00 |
| Di-sodium salt of chelidamic acid | 18.40 |
| Carboxy Methyl Cellulose (CMC) | 0.50 |
| Brighteners | 0.84 |
| $Na_2SO_4$ | 10.26 |
| Water | 10.00 |
| | 100.00 |

In one set of tests, cotton cloths are repeatedly soiled by rubbing these cloths against human skin at various periods during the day followed by evenly dividing these cloths and washing, utilizing the above noted dry detergent and the phosphate built control product in a laboratory Terg-o-tometer washing machine. Reflectometer readings are taken on the washed cloths and are compared to determine the extent of soil removal, which is utilized to perform a statistical analysis to establish whether or not a difference exists between the washing abilities of the materials tested.

The statistical analysis shows that the instant heavy duty dry detergent containing no phosphates performs as satisfactorily as the control product which contains approximately 35% of polyphosphates. Following repeated resoiling and rewashing of the same materials, the same results are obtained. When the above noted dry heavy duty detergent is tested against a commercial product utilizing a bundle test having a variety of soiled articles of clothing made of cotton, polyester-cotton blends, rayon and nylon, utilizing a full size automatic washing machine, the small scale Terg-o-tometer test results are confirmed.

Similar results are obtained when the Neodol 25-3S is replaced by the higher fatty alcohol ethoxylate sulfates including those wherein the higher fatty alkyl is mixed $C_{12-13}$ or $C_{14-15}$; however, it appears that the mixture of $C_{12-15}$ is a better washing agent in the present composition than the narrower cuts of higher fatty alcohol derivatives.

Instead of the mixture of soda ash and chelidamic acid being utilized as builders, sodium citrate dihydrate and other forms of citric acid intermediate salts may be utilized, including the potassium, ammonium and lower alkylamine salts of these materials.

EXAMPLE 9

The formulation of Example 3 is repeated except that the Neodol 25-3S is replaced by the following amounts of Neodol 25-3S and combinations of 25-3S and other synthetic detergents:

a. 52.2% Neodol 25-3S and 13% Neodol 4511 ($C_{14-15}$ alkyl polyethenoxy non-ionic containing 11 moles of ethylene oxide);

b. 70% Neodol 25-3S;

c. 35% Neodol 25-3S and 15% Neodol 4511;

d. 50% mixed $C_{14-15}$ normal primary alkyl mixed tri and tetraethenoxy sulfate;

e. 45% stearyl pentaethenoxy sulfate, triethanolamine salt and 10% mixed $C_{12-15}$ normal primary alkyl plus 7 ethylene oxide groups; and f. 31.0% Neodol 25-3S, 10.3% Neodol 4511 and 4.7% of linear dodecyl benzene sulfonate.

Each of the above noted liquid detergent formulations produces a clear, one-phase material which has a low viscosity and is rapidly dispersed upon pouring into still water at 38°C without stirring. Furthermore, each of the above noted detergent compositions possesses excellent detersive properties and compares favorably with phosphate built heavy duty liquid detergent compositions.

EXAMPLE 10

In each of the detergent formulations of Examples 1, 3, 4, and 5, the isopropanol is replaced with the following monohydric and polyhydric alcohols:

| | |
|---|---|
| A | Ethanol |
| B | n-propanol |
| C | n-butanol |
| D | sec-butanol |
| E | t-butanol |
| F | Ethylene Glycol |
| G | Propylene glycol |
| H | Glycerol |

All of the cleaning compositions were clear and possessed excellent detersive properties.

EXAMPLE 11

This example demonstrates the suitability of additional sequestration agents in detergent compositions with the builders of this invention. The following conventional detergent builders, such as sodium tripolyphosphates and NTA, are substituted for part of the disodium salt of chelidamic acid in the formulation of Ex. 4:

| | |
|---|---|
| A | Detergent of Example 4 |
| B | Detergent of Example 4 with ½ of the builder replaced with sodium tripolyphosphate |

-continued

| | |
|---|---|
| C | Detergent of Example 4 with ½ of the builder replaced with NTA. |

Fabrics are washed in the manner of Example 7 and examined for comparative results. No discernible visual difference can be noted among the fabrics washed with samples A, B and C. Reflectometer readings verified these results as no Rd value differed greater than 1 unit.

EXAMPLE 12

Examples 1–11 are each repeated using "4H" acid in place of chelidamic acid. The results are comparable.

While the builders of the present invention have been illustrated by way of the foregoing specific examples, such examples and specification are for the purposes of illustration only and are to be in no way taken as limiting the scope of the present invention, which is properly defined by the appended claims.

What is claimed is:

1. A detergent composition consisting essentially of 19 percent by weight of $RO(C_2H_4O)_3SO_3Na$ wherein R is a mixed $C_{12-15}$ normal primary alkyl group, 12 percent by weight of sodium sulfate, 10.3 percent by weight of a condensation product of higher fatty alcohol of 14 to 15 carbon atoms with 11 moles of ethylene oxide, 22 percent by weight of chelidamic acid, 10.3 percent by weight of linear dodecyl benzene sulfonate, 8.6 percent by weight of isopropyl alcohol and the balance water.

* * * * *